United States Patent [19]

Belokin, Jr.

[11] 4,193,351

[45] Mar. 18, 1980

[54] DISPLAY RACK ASSEMBLY

[76] Inventor: Paul Belokin, Jr., Rte. 4, Hayward, Wis. 54843

[21] Appl. No.: 960,959

[22] Filed: Nov. 15, 1978

[51] Int. Cl.[2] ..... A47B 57/00; F16M 13/00

[52] U.S. Cl. ..... 108/59; D6/24; 108/106; 108/111; 206/44 R; 211/49 S; 248/158

[58] Field of Search ..... 211/49 R, 49 S, 74; 108/105, 103, 59, 91, 111, 106, 107, 144; 206/503, 501, 821, 44 R, 311; D6/24; 248/158

[56] References Cited

U.S. PATENT DOCUMENTS

| | | | |
|---|---|---|---|
| 613,985 | 11/1898 | Gadbury | 108/103 |
| 2,555,594 | 6/1951 | Markovitz | 206/309 |
| 2,663,104 | 12/1953 | Hoagland | 211/49 R X |
| 2,951,593 | 9/1960 | Lake | 108/103 X |
| 3,182,613 | 5/1965 | Hagan | 108/61 |
| 3,295,671 | 1/1967 | Wuench et al. | 206/44 R |
| 3,543,699 | 12/1970 | Leikarts | 108/59 |
| 3,612,288 | 10/1971 | Lesley | 211/49 S |
| 3,626,871 | 12/1971 | McClendon | 108/103 X |
| 3,672,723 | 1/1972 | Decurso et al. | 108/91 X |
| 3,991,686 | 11/1976 | Mechachonis | 108/103 X |

FOREIGN PATENT DOCUMENTS

| | | | |
|---|---|---|---|
| 2321999 | 11/1974 | Fed. Rep. of Germany | 206/503 |

*Primary Examiner*—James T. McCall
*Attorney, Agent, or Firm*—James E. Nilles

[57] ABSTRACT

A knock-down display rack for displaying articles, such as bottles or the like, at the point of purchase and which includes a vertical support member extending from a base and also includes a series or removable and unattached shelves for supporting layers of the articles, one shelf being located between each layer of articles. The shelves each have a slot therein and extending from its periphery to the central portion of the shelf whereby the shelves may be inserted around vertical support for resting on the layer of articles therebeneath. The slots of the shelves are non-aligned with one another, that is they extend in different directions, thereby each shelf prevents the others from all being disengaged by a single lateral movement of the display rack, and thereby provide stability to the display rack.

9 Claims, 2 Drawing Figures

DISPLAY RACK ASSEMBLY

BACKGROUND OF THE INVENTION

Various display racks or shelving arrangements have been proposed for completely displaying products to be sold and which permit easy access to the products by the shopper. Many of these prior art display devices have vertically spaced shelves or supporting units which are attached to a vertical wall or the like by means of hinges or catches, whereby they can be swung from a vertical stored position to a horizontal load supporting position. In these devices however, it is difficult to move the empty shelf to an inoperative position due to space restrictions or due to interference with other products in the display. Furthermore, some of these prior art devices are complicated and contain numerous parts which are costly to manufacture, time consuming to clean and are difficult to store in a compact manner. An example of such a prior art device is shown in U.S. Pat. No. 2,825,466 which issued Mar. 4, 1958.

Other prior art display devices have been proposed for stacking bottles in layers, one on top of another, but they present some difficulty to the purchaser in removing bottles from the display and are furthermore objectionable because they do not provide the necessary stability against inadvertent tipping of the entire display assembly. An example of this prior art is shown in U.S. Pat. No. 2,120,610 which issued June 14, 1938 wherein the tray-like units cooperate with the tops and bottoms of the articles when the latter are arranged in superposed groups in supporting and confining the articles against unauthorized removal from the stand.

Another example of the prior art is shown in the British Pat. No. 10,277 of 1906, but that patent does not teach the use of alternately positioned slots in the trays, the quickly removable center support, nor the rectangularly shaped base.

SUMMARY OF THE PRESENT INVENTION

The present invention provides a knock-down type display rack assembly which has a base adapted to rest on the floor and from which a vertical support extends upwardly therefrom. The vertical support is securely but removably anchored in the base. A series of horizontal and unattached shelves are mounted around the vertical support and in vertically spaced relationship to one another, the articles, such as bottles, cans or the like, being located between adjacent shelves and supporting the latter on their upper ends. The shelves are freely slideable up and down on the central support to accommodate articles of different heights. The shelves also include a slot therein and extending from the periphery of the shelf to a generally central portion thereof. The slot of the shelf is slipped past, i.e. around, the vertical support to the inner extremity of the slot. The slots of the adjacent shelves are non-aligned with one another, that is they extend in different directions to provide good stability for the assembled display due to the fact that if the display is accidentally pushed in one direction which coincides with the direction of the open-ended slot, all of the shelves will not be pushed free of engagement with the vertical support. Instead, the shelves offer lateral stability to one another due to the engagement of the vertical support in the inner ends of the non-aligned slots.

In use, the shelves and the weight of the articles placed thereon are supported by the lower layer of articles and there is no need to otherwise fasten the shelves. The non-aligned slots of various shelves engage the vertical support in such a manner that they cannot all be disengaged from the vertical support by being shifted or pushed in any one particular direction, thus providing good stability to the assembled unit. The display assembly provided by the present invention can be quickly stored and assembled as the articles to be displayed are stacked in layers, one shelf being provided between each layer of articles. As the articles are sold from the uppermost layer, and the supporting shelf of that layer becomes bare, that bare shelf can be easily removed from the assembly and stored in a convenient location thereby completely exposing the next downwardly succeeding layer of articles. Thus the entire assembly can be quickly assembled and disassembled, stored, and transported and reused as desired.

These and other objects and advantages of the present invention will appear hereinafter as this disclosure progresses, reference being had to the accompanying drawings.

DESCRIPTION OF A PREFERRED EMBODIMENT

Figure 1:
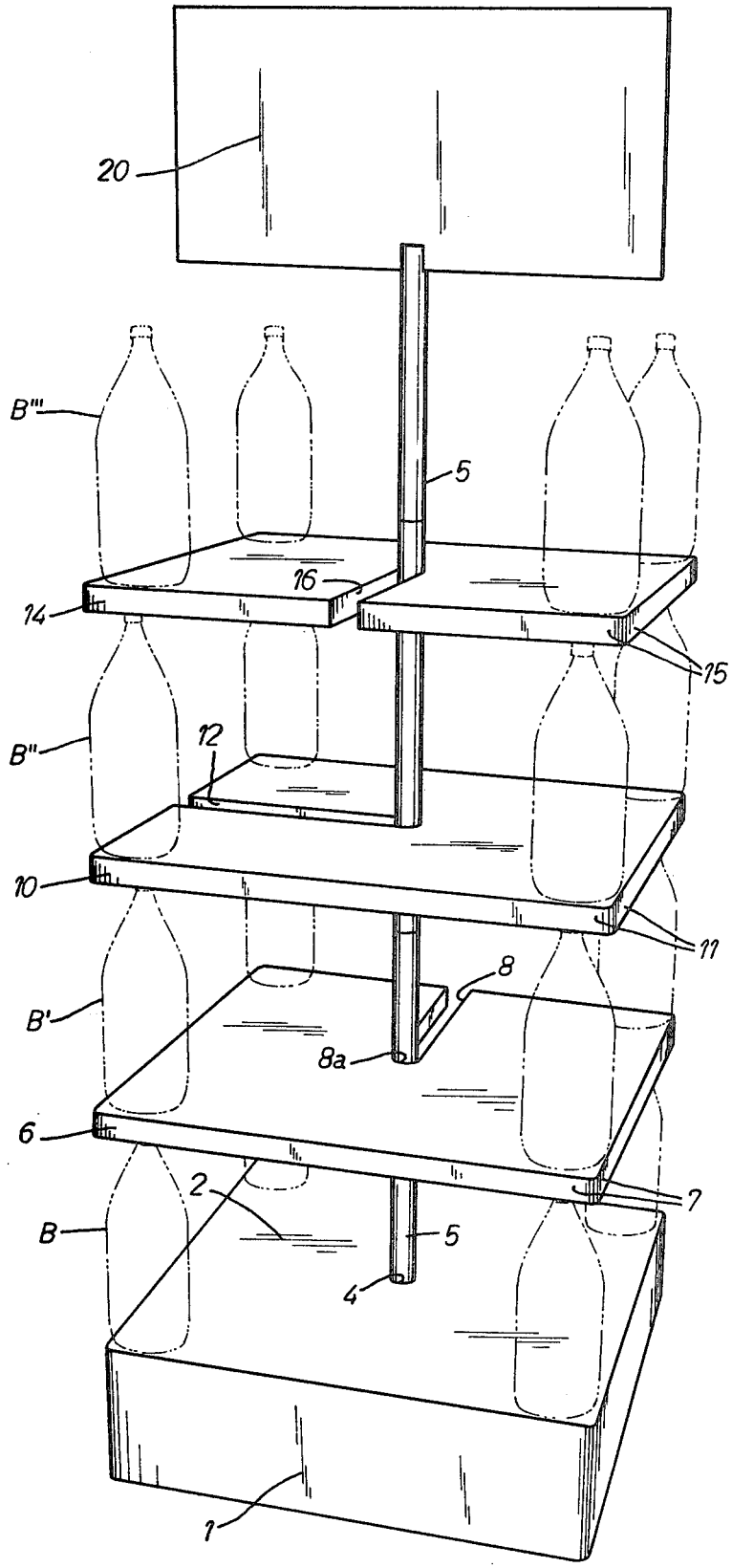
FIG. 1 is a perspective view of a display assembly made in accordance with the present invention and only showing some of the articles stacked therein in phantom lines for the sake clarity.

The display assembly provided by the present invention is preferably made of lightweight yet rigid and strong material such as expanded polystyrene styrofoam and finds particular utility when stacking plastic bottles or other irregularly shaped articles for easy access by the respective purchaser, such as for example in supermarkets. Irregularly shaped articles, such as bottles are difficult to stack, whereas six-packs of canned goods for example can be stacked one on top of another without the aid necessarily of intervening shelves and the present invention provides a quickly assembled and disassembled knock-down rack which offers considerable stability against being tipped over by inadvertent bumping by customers against the display.

The display assembly provided by the present invention includes a base member 1 of sufficient size to provide stable support against tipping or over-turning. The base includes a flat upper surface 2 and also includes side wall means which are of sufficient height to provide space thereon for advertising and also of a sufficient height to provide good support for a central vertical support 5 extending therefrom. More specifically, the central vertical support may take the form of a rigid pole which at its lower end is inserted in a vertical hole 4 located in the centrally base 1. The vertical support 5 can be easily slid in or removed from the base, but forms a snug connection therewith. Pole 5 is made in quickly separable sections telescoped together (FIG. 2).

A first layer of articles, such as bottles B for example, are then placed on the upper flat surface 2 of the base and when that surface is filled, a first shelf 6 is placed on top of the bottles B and supported thereby. That is to say, the shelf 6 has a slot 8 extending from the periphery thereof inwardly to the generally central portion of the shelf, the slot 8 terminating as at 8*a* where it abuts against the support 5 after the shelf has been slid into place. Stated otherwise, the shelf is inserted horizontally over the lower bottles and the slot 8 slides past the vertical support in a closely fitting relationship. The lower layers of bottles form a good and firm support for the shelf 6. A second layer of articles, such as bottles B′, is then placed on the shelf 6 and when the latter is full, a second shelf 10 similar to shelf 6, is horizontally slipped past the pole 6 by means of its slot 12, the shelf 10 resting firmly on top of the bottles B′ and supported thereby. It will be noted that the slot 12 extends in a non-aligned or different direction from the adjacent, lower slot 8. A layer of bottles B″ are then placed on top of shelf 10 and when the latter is filled, a third shelf 14 having a slot 16 is similarly slipped around pole 5. It will again be noted that the slot 16 extends in a direction differnt from the slot 12 of the adjacent shelf 10. A layer of bottles B‴ are then placed on top of shelf 14 and if such layer is the last one in the assembly, it is easily accessible to the purchasing public and the bottles can be easily removed from the open shelf 14.

Any number of shelves may be used and of course their shape can take any desired form. In the illustration shown, it will be noticed that shelves 6, 10 and 14 have side edges 7, 11 and 15, respectively, on which advertising or pricing information may be attached. A removable advertising sign 20 can also be inserted on top of the center support or pole 5.

Figure 2:
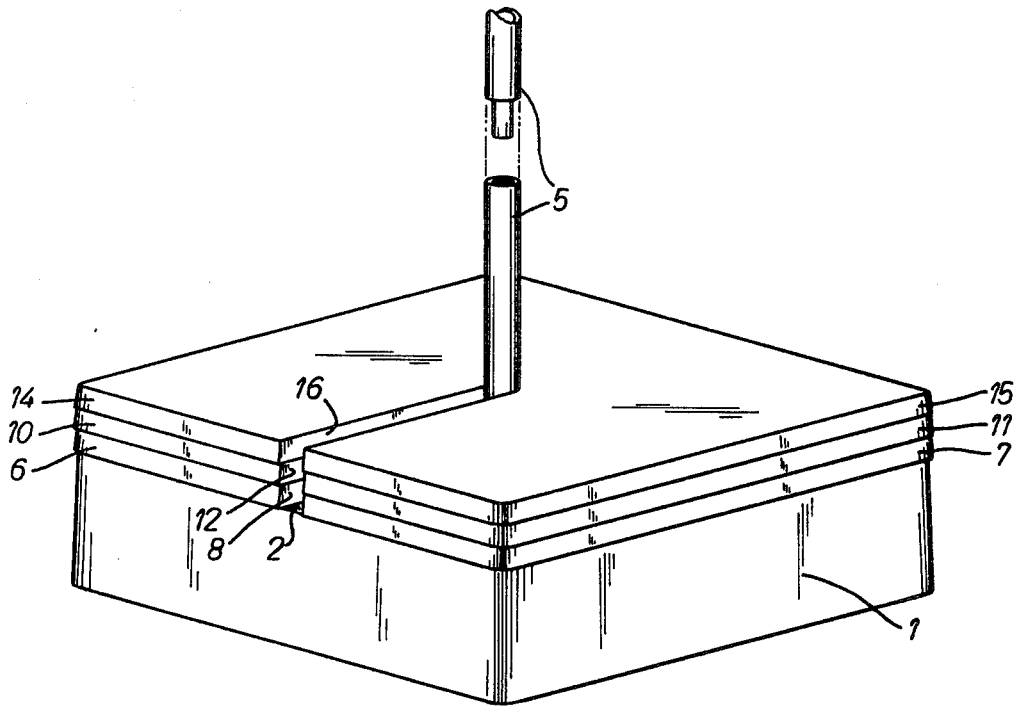
FIG. 2 shows the display assembly when completely disassembled and stacked for storage.

FIG. 2 shows the assembly when it is completely disassembled and stacked in a compact manner.

The shelves of the present assembly can be used repeatedly and can be slid up and down on the central support as required by the height of the products to be displayed. The articles support the shelves and the shelves in turn support one another, particularly against lateral displacement due to the non-aligned slots in the shelves and which are inserted over the vertical support and staggered as to their position around the support. The articles are sold from the uppermost layer and downwardly and the shelves and successively removed from the top, the removal of a shelf completely exposing the next shelf of articles for easy access.

While the base may be of different forms, it is preferably that the base be of rectangular shape when viewed in plan and of substantial size to prevent gyration of the entire assembly, for example when the assembly is accidentally bumped.

While FIG. 1 shows only a few bottles in phantom lines on each shelf, it will be understood that the shelves would be filled with similar bottles for example, and with the arrangement shown, 144 bottles consisting of approximately 720 pounds of product can be compactly stored, displayed, and easily removed.

In addition to the storage position shown in FIG. 2, the pole 5 can be removed completely and the base and shelves set on their edge for a more efficient use of the floor space.

I claim:

1. A knock-down type display rack assembly for supporting layers of articles, said assembly including a floor engaging base having an upper generally horizontal surface for supporting a layer of articles, a vertical support mounted in and extending upwardly from said base, a plurality of generally horizontal shelves each having a slot extending from its periphery and inwardly to a generally central portion of said shelves, said slots being insertable over said vertical support to thereby vertically align said shelves with one another, the slot of any one shelf being in non-vertical alignment with the slot of an adjacent shelf to thereby prevent all of said shelves from being slid away from said vertical support at any one time by a lateral thrust thereagainst in any one direction, a layer of articles located between adjacent shelves and on which layers the upper adjacent shelf, respectively, is supported.

2. The assembly set forth in claim 1 further characterized in that said base has a generally centrally located aperture therein, said aperture extending in a generally vertical direction, and said vertical support is removably inserted in said aperture for snug engagement therewith.

3. The assembly set forth in claim 1 further characterized in that said base and shelves are formed from expanded polystyrene styrofoam and are of generally similar shape.

4. The assembly set forth in claim 1 wherein the vertical support is quickly and easily removed from said base by simple upward movement of said support and said base is of rectangular form when viewed in plan.

5. A knock-down type display rack assembly for supporting vertically stacked layers of irregularly shaped articles, said assembly including a floor engaging base having an upper generally horizontal surface for supporting a layer of articles, said base also having a generally centrally located aperture therein, said aperture extending in a generally vertical direction, a vertical support removably and firmly mounted in said aperture and extending upwardly from said base, a plurality of generally horizontal shelves for supporting articles thereon and each shelf having a slot therethrough and extending from the periphery of said shelf and inwardly to central portion thereof, said slots being horizontally insertable around said vertical support to thereby vertically align said shelves with respect to one another, the slot of any one shelf extending in a direction different than the slot of an adjacent shelf to thereby prevent all of said shelves and articles thereon from being slid away from and disengaged from said vertical support at any one time due to a lateral shifting thereof, and a layer of articles located between adjacent shelves and on which layers the upper adjacent shelf, respectively, is supported.

6. The assembly set forth in claim 5 further characterized in that said base and shelves are formed from expanded polystyrene styrofoam and are of generally similar shape whereby they can be stacked compactly together in a knocked down storage position.

7. The assembly set forth in claim 5 wherein the vertical support is quickly and easily removed from said base by simple upward movement of said support and said base is of rectangular form when viewed in plan.

8. A knock-down display rack assembly for supporting articles and including a floor engaging base having an upper generally horizontal surface for supporting a layer of articles, said base being rectangular in form when viewed in plan and having a generally centrally located aperture therein and extending in a vertical direction, a vertical pole mounted in said aperture and extending upwardly from said base, said vertical pole removably and snugly inserted in said aperture and being quickly and easily removed from said base by simple upward movement of said support, a plurality of generally horizontal shelves each having a slot extending from its periphery and inwardly to a generally central portion of said shelves, said slots being insertable around said vertical pole to thereby vertically align said shelves with one another, the slot of any one shelf being in non-vertical alignment with the slot of an adjacent shelf to thereby prevent all of said shelves from being slid away from said vertical pole at any one time by a lateral thrust thereagainst in any one direction, said base and shelves being formed from expanded polystyrene styrofoam and are of generally similar shape, a layer of articles being locatable between adjacent shelves and on which layers the upper adjacent shelf, respectively, is supported.

9. A knock-down display rack assembly for supporting irregularly shaped articles and including a floor engaging base having an upper generally horizontal surface for supporting a layer of articles, said base also having a generally centrally located aperture therein which extends in a vertical direction, a vertical support removably and firmly mounted in said aperture and extending upwardly from said base, said vertical support being quickly and easily removed from said aperture in said base by simple upward movement of said support, said base being of rectangular form when viewed in plan, said vertical support being formed in quickly separable sections detachably connected together, a plurality of generally horizontal shelves for supporting articles thereon and each shelf having a slot therethrough and extending from the periphery of said shelf and inwardly to central portion thereof, said slots being horizontally insertable around said vertical support to thereby vertically align said shelves with respect to one another, the slot of any one shelf extending in a direction different than the slot of an adjacent shelf to thereby prevent all of said shelves and articles thereon from being slid away from and disengaged from said vertical support at any one time due to a lateral shifting thereof, and a layer of articles located between adjacent shelves and on which layers the upper adjacent shelf, respectively, is supported, said base and shelves being formed from expanded polystyrene styrofoam and are of generally similar shape whereby they can be stacked compactly together in a knocked down storage position.

* * * * *